United States Patent [19]

Dimick

[11] Patent Number: 4,882,467

[45] Date of Patent: Nov. 21, 1989

[54] ELECTRIC WARM AIR MIRROR DEFOGGING DEVICE

[76] Inventor: Keene P. Dimick, 3076 Redwood Rd., Napa, Calif. 94558

[21] Appl. No.: 74,405

[22] Filed: Jul. 16, 1987

[51] Int. Cl.[4] ..... H05B 1/00; F24H 3/04; F21V 33/00; E06B 7/12

[52] U.S. Cl. ..... 219/219; 34/97; 34/243 R; 219/220; 219/366; 219/367; 219/370; 362/140; 362/141

[58] Field of Search ..... 219/366–372, 219/379, 380, 220, 375, 219, 374; 362/141, 140; 34/96–101, 243 R

[56] References Cited

U.S. PATENT DOCUMENTS

| | | | |
|---|---|---|---|
| Re. 25,402 | 6/1963 | Myerberg | 362/141 |
| 785,004 | 3/1905 | Klemm et al. | 219/369 X |
| 896,554 | 8/1908 | Kyle | 219/366 X |
| 999,880 | 8/1911 | Schaeffer | 219/369 X |
| 1,222,837 | 4/1917 | Winslow et al. | 219/372 X |
| 1,327,986 | 1/1920 | Clark et al. | 219/366 X |
| 1,374,658 | 4/1921 | Hohmsbeen | 219/370 |
| 2,133,188 | 10/1938 | Comforti | 219/220 |
| 3,384,977 | 5/1968 | Rosenberg | 219/370 X |
| 3,737,646 | 6/1973 | Burows | 362/140 |

FOREIGN PATENT DOCUMENTS

| | | | |
|---|---|---|---|
| 549038 | 4/1932 | Fed. Rep. of Germany | 219/375 |
| 1097055 | 1/1961 | Fed. Rep. of Germany | 219/374 |
| 3101933 | 9/1982 | Fed. Rep. of Germany | 219/370 |
| 3520999 | 12/1986 | Fed. Rep. of Germany | 219/370 |

*Primary Examiner*—Anthony Bartis
*Attorney, Agent, or Firm*—Skjerven, Morrill, MacPherson, Franklin & Friel

[57] ABSTRACT

A bathroom mirror defogger includes a translucent spherical psuedo light bulb-type housing having an electric plug base extending therefrom along the central axis of the housing and adapted to be screwed into a lamp socket in a light bar immediately juxtaposed to a side and/or top edge of a bathroom wall mirror. The housing is provided with an air inlet and an air outlet and encloses an electric heating coil and motor driven fan. The air outlet is positioned laterally of the central axis on a portion of the housing rotatable about the central axis so that the orientation of the outlet can be adjusted relative to the mirror surface. The fan aspirates air through the inlet across the heating coil and pumps the resultant warmed air out through the outlet and against the mirror surface to remove or prevent moisture condensation thereon from a shower or hot water present in the bathroom.

16 Claims, 1 Drawing Sheet

ELECTRIC WARM AIR MIRROR DEFOGGING DEVICE

BACKGROUND OF THE INVENTION

1. Field of the Invention

This invention relates to mirror defoggers.

2. Description of the Prior Art

Blower or blower and heater devices have previously been designed to reduce or decrease the amount of condensation on bathroom or other mirrors. Examples of prior art defogging devices are described in U.S. Pat. No. 2,617,701 (Fennell) and U.S. Pat. No. 4,037,079 (Armbruster). These prior art defogging devices are designed in a manner which is not visually attractive, and which requires extensive and expensive work for installation in any retrofit application, such as new electrical wiring switches, installation of brackets or installation of the defogging unit in the wall of the bathroom. Original installations of these prior art devices include multipart expensive custom construction and installation. Each also requires a separate on-off switch and in the '079 device a dedicated wall electrical outlet socket and a pigtail plug extension.

SUMMARY OF THE INVENTION

The mirror defogger of the present invention directs a stream of heated air across the bathroom or other mirror, from any edge of the mirror. In the preferred embodiment, it is similar in shape to a conventional or modern bathroom vanity light bult, such as is typically screwed into a series of light bulb sockets on a light bar positioned on the top, sides and/or bottom of a bathroom mirror. The defogger can be installed without the need for any additional electrical wiring, installation of brackets or other special preparation. It is automatically "on" when the lights in the bathroom are themselves turned "on".

The mirror defogging device can be purchased at a typical retail lighting or hardware store at a comparably inexpensive price and be easily and simply screwed in a preexisting light bulb socket such as in a light bar by a homeowner, and is automatically activated by the light bar wall switch when the light bar is turned on.

The defogging device has a pleasant, simple appearance and which does not noticeably detract from the normal appearance of the bathroom mirror and its surrounding lights. In impression it is a pseudo light bulb. It has a low noise characteristic, is essentially maintenance-free and does not interfere with mirror cleaning. The defogger is concealed in that in outer appearance it appears to be an ordinary looking vanity light bulb.

DETAILED DESCRIPTION

Figure 1:
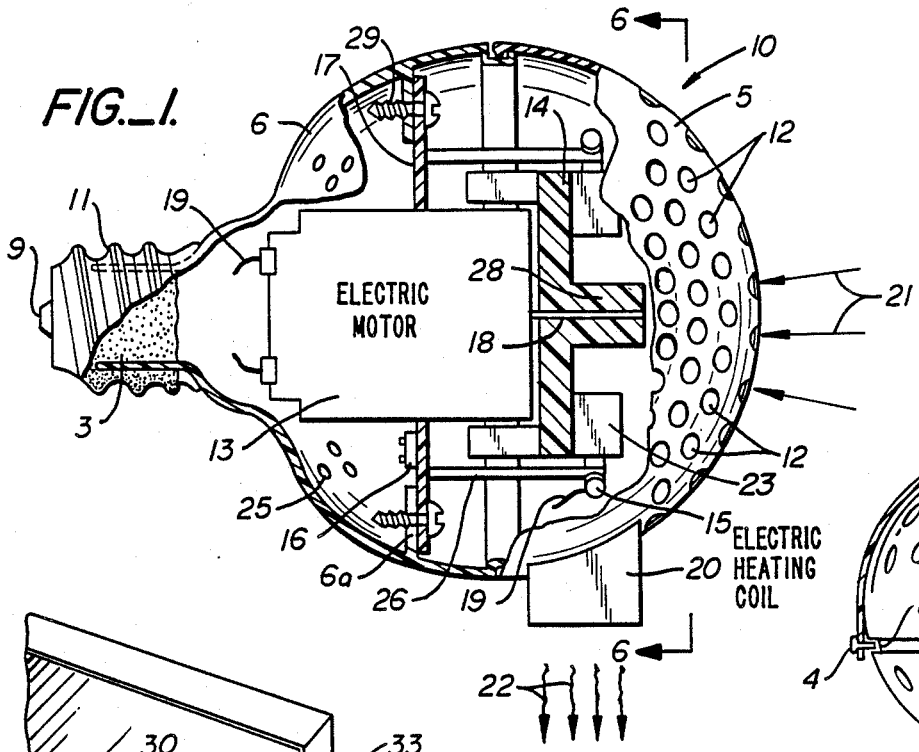
FIG. 1 is a side cutaway cross-sectional view illustrating the preferred embodiment of the mirror defogger of the present invention showing front and back substantially hemispherical parts of the globular housing.

Referring now particularly to FIG. 1, an envelope 10 generally designates the outer wall housing structure of the mirror defogger, which in one embodiment is globular in shape similar to a standard vanity light bulb. The housing structure 10 is normally constructed of a pair of substantially hemispherical bulb sections 5, 6 of transulcent, injection molded, off-white, thin plastic such as ABS (Acrylonitrile-Butadiene-Styrene) thermoplastic with suitable heat characteristics, i.e. a continuous service temperature of about 120° F. and have dimensional integrity under powered usage. A threaded stem 11 with a metal jacket forming an Edison-type plug base extends from an inner end of the mirror defogger bulb and has metal threads sized for screwing into any standard light bulb socket providing a source of AC voltage. A central electrode contact 9 as is known in the bulb art is also provided. In an alternative configuration, the electrical socket base may be a dual or triple-pronged base which is inserted into a conventional electrical outlet adjacent the mirror or into a plug adapter socket itself screwed into a light bulb socket.

Figure 6:
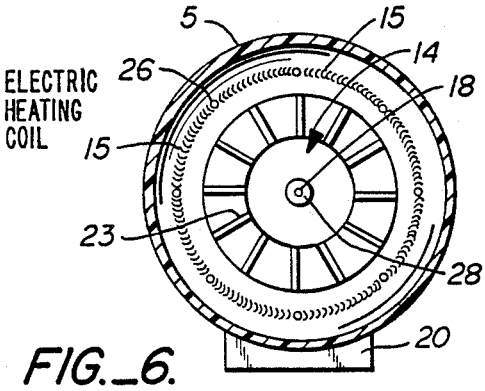
FIG. 6 is a section view of the defogger taken on the line 6—6 of FIG. 1.

Inner and outer translucent hemispherical sections 5 and 6 of the defogger contains inlet apertures 12 and 25, respectively, the former serving as air inlets. Ambient air 21 is drawn into the defogger by aspiration through the inlet apertures or perforations 12 of about 3 mm in diameter, by operation of a rotary squirrel cage fan 14 with circumferential vanes 23 extending from fan hub 28. Fan 14 is driven by a small electrical, normally DC, motor 13 operating at from 3 to 24V with a power of 3 to 15 watts. Apertures 25 in the inner or back hemisphere 6 allow for exit of heated air from motor operation. Motor shaft 18 passes through a mounting plate 17 for motor 13, to rotate fan 14. As the air is drawn into the bulb through apertures 12, the air passes over a resistance sprial wire coil 15 extending around the outer side of the fan and connected to the voltage source and mounted by insulating, thermally stable, rod-like supports 26 to plate 17. FIG. 6 shows the circular coil 15 surrounding the fan blades 23 and positioned to heat incoming air which is subsequently pumped out exit 20 as warmed air.

Plate 17 may be also utilized to mount a circuit board 16 containing the other elements of the circuit of FIG. All the mounted parts, i.e., the motor and its mounting plate, the fan, the coil and the electronic parts including a thermal fuse, are mounted on the rear hemispherical section 6 of the defogger by screws 29 threadedly extending into a mounting ridge **6*a* integrally molded with inner bulb section 6. This section also is a translucent plastic section held in place in the stem 11 by suitable cement 3**.

Room air is heated to temperatures of about 30° F. to 50° F. above ambient in the defogger. The coil may comprise a 600 cm length of Nichrome B & S 29 wire having a resistance of about 5.29 ohms/foot, a diameter of 0.011 inch, and having a wattage of about 100 watts. Suitable connecting wires 19 connect the resistance coil and motor leads to electrical contacts (not shown) within socket stem 11. The fan exhausts the heated air through an air outlet 20 of the defogger as shown by the arrows 22. The air exit may be circular or rectangular in cross section and preferably extends over from about 30° to 90° of arc of the globular bulb.

The defogger is installed by screwing the threaded stem 11 into a standard light bulb socket. The air outlet portion 20 is oriented adjacent to the mirror so a stream of warmed air which issues from air outlet will be blown toward, over and against a surface of the mirror generally parallel to the mirror surface.

Figure 4:
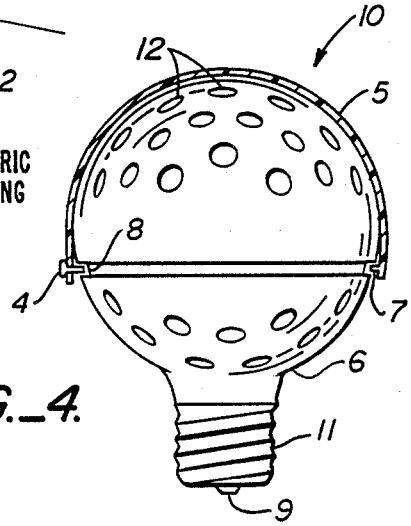
FIG. 4 is a side partially sectional view of a slip joint connection between a rear hemispherical section and a front hemispherical bulb section of the defogger prior to final assembly.

The defogger may be adjusted, by rotating the substantially hemispherical, globular outer section 5 of the device in a slip joint including a slot 8 in the inner section 6 (FIG. 4) to direct exiting warmed air to a desired unobstructed-with-condensation area of the mirror. The globular outer housing section 5 may be secured in any position with respect to the inner section 6 by use of one or more set screws 4 (FIG. 4). An inwardly-facing ridge 7 on the interior of the outer hemisphere 5 extends over about 360° of arc of the bulb and is snapped into groove 8 of the flange 6 and set screw 4 tightened in the manufacturing assembly process. When the defogger bulb has been screwed into a socket 36 (FIG. 2) the set screw may be loosened and the globular bulb section 5 rotated in either direction in slot 8 to a position where the exiting air stream is directed to area 38 or 39 (FIG. 2) or other mirror area adjacent the defogger. While the user may adjust the position of section 5 with respect to section 6, the two sections are firmly held together preventing access of the user to the interior of the bulb. Users are to be warned that the sections are not to be pried apart.

In a test of a 22 inch high and 16 inch wide mirror in a home bathroom at 96 watts of heat and slow fan speed, the room air was heated in the defogger to 27° F. above ambient bathroom temperature. Following a four minute shower which substantially fogged the mirror, 20% of the mirror cleared in one minute during a tooth brushing period. During a shaving period the mirror cleared from top to bottom and about ⅔ across the mirror width.

Figure 2:
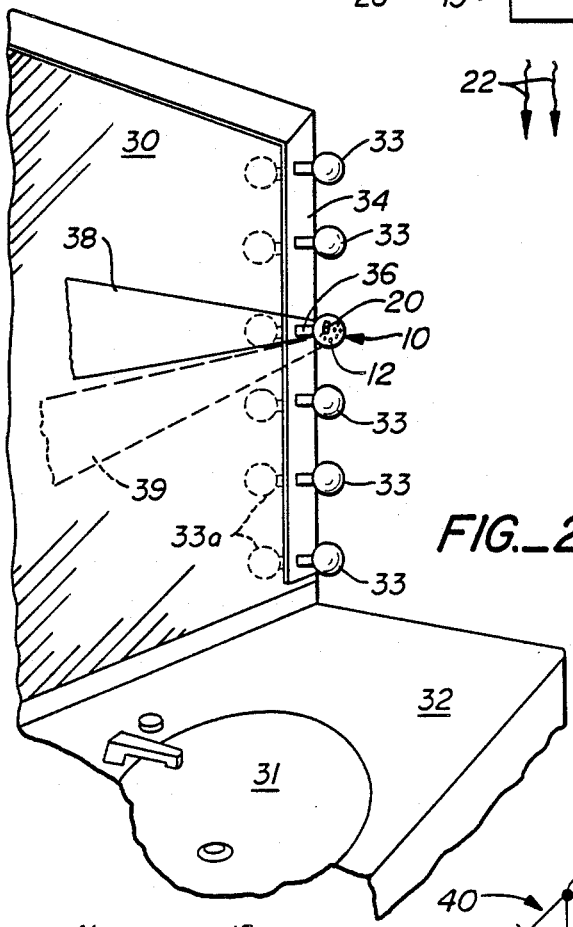
FIG. 2 is a front prospective view showing the mirror defogger in a typical light bar installation adjoining a bathroom mirror.

In FIG. 2, a wall-mounted mirror 30 is shown positioned over a bathroom sink 31 and counter 32. A series of light bulbs 33 are mounted on a side or top edge of the mirror in a light bar 34. Reflections 33*a* of the light bulbs are seen on the mirror surface. Defogger pseudo bulb 10 is also screwed into one of the sockets 36 in the light bar. Defogger bulb air outlet 20 directs an arc pattern 38 of heated air on the mirror. The defogger bulb is adjustable to move pattern 38 to dash line position 39 or to intermediate or other positions.

The defogger does not destroy the symmetry of multiple electrical globular bulbs on the mirror standard light bar. The defogger bulb is of the same size and general appearance as the normal light bar bulb except for the air inlet apertures and air outlet aperture. In a second embodiment the defogger pseudo- bulb may be equipped with its own light source such as a sealed toroidal fluorescent bulb surrounding motor within bulb 10.

Figure 3:
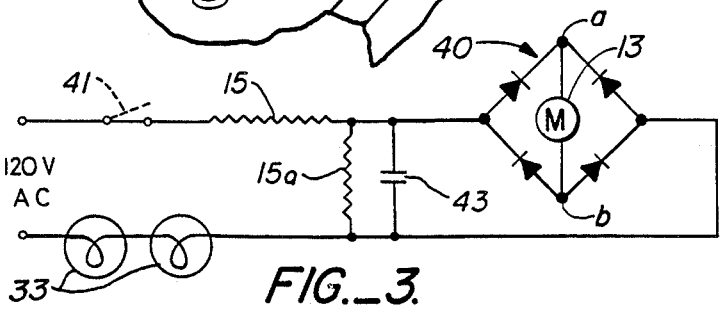
FIG. 3 is a typical circuit diagram of the defogger.

In the FIG. 3 circuit diagram, the heater coil 15 of approximately 100 watts is series connected to a full wave rectifier 40 and the motor 13. Node a of the rectifier is connected to one motor terminal and node b is connected to the other motor terminal. The final voltage to the motor is adjusted by the size of shunt 15a and is smoothed by a condenser or filter 43. Normally the defogger bulb operates when the light bar itself is switched on. However, a switch 41 may be also provided in the circuit (shown closed in solid line and open in dotted line) and a switch operator (not shown) provided extending through a side wall of section 6. Also as shown in FIG. 3, the defogger bulb may operate in series with light bulbs 33 positioned in other of the light sockets in light bar 34.

FIG. 4 shows in more detail the internal ridge 7 of outer hemispheric bulb section 5 about to be snapped into the groove 8 of the inner bulb section.

Figure 5:
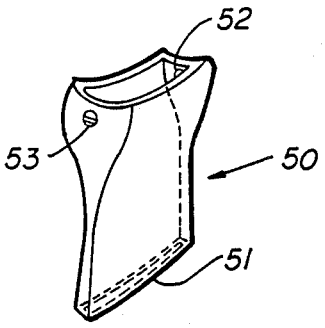
FIG. 5 is a perspective view of an air outlet adapter.

FIG. 5 shows an air conduit adapter 50 having a nozzle exit portion 51 and an entrance portion 52, the latter being insertable over the outlet aperture 20 of the FIG. 1 embodiment and locked in place by set screw 53. The adapter adjusts any variable distance between the mirror surface and the light bar socket so that the heated air stream is more closely directed to the area of the mirror at which initial clearing of the fogged condensation is desired.

Although the best mode contemplated for carrying out the present invention has been herein shown and described, it will be apparent that modification and variation may be made without departing from what is regarded to be the subject matter of the invention.

I claim:

1. A mirror defogging device comprising:

a globular pseudo light bulb-type housing having a central axis;

an electrical plug base fixedly extending from said housing along said central axis for connection to an electrical lamp socket adjacent a mirror surface; and wherein said globular housing includes an air inlet extending through a surface thereof, a resistance heater in said housing, a rotating fan within said housing, a motor in said housing for rotating said fan, said air inlet, heater, fan and motor being axially aligned along said central axis of said housing, and an air outlet laterally offset from said central axis, extending through said housing and in exit flow communication with said fan such that air entering said housing through said inlet is heated and directed by said fan to said outlet for discharge laterally to a mirror surface.

2. The device of claim 1 in which said plug base is a screw threaded Edison-type base.

3. The device of claim 1 in which said air inlet comprises a series of spaced apertures extending through an outer wall of said housing.

4. The device of claim 1 in which said resistance heater comprises a spiral resistance wire coil interposed between said air inlet and said fan.

5. The device of claim 1 including a rotary joint between the portion of said housing provided with said air outlet and the remainder of said housing for orienting said air outlet and directing warmed outlet air to various positions on a mirror.

6. A mirror defogging device comprising:

a globular housing having a central axis;

an electrical plug base fixedly extending from said housing along said central axis for connection to an electrical lamp socket adjacent a mirror surface;

said globular housing including an air inlet extending through a surface thereof, a resistance heater in said housing, a rotating fan within said housing, a motor in said housing for rotating said fan, and an air outlet extending through a portion of said housing and being laterally offset from said central axis, said outlet being in exit flow communication with said fan such that air entering said housing though said inlet is heated and directed by said fan to said outlet for discharge to a mirror surface; and including a rotary joint between the portion of said housing provided with an air outlet and the remainder of said housing for laterally orienting said air outlet and directing warmed outlet air to various positions on a mirror; and in which said joint is a slip joint having an unlimited arc of rotation.

7. The deive of claim 6 in which said globular housing comprises an inner hemispherical translucent section and an outer hemispherical translucent section connected to said inner section by said rotary joint one of said sections defining said portion of the housing provided with said air outlet.

8. The device of claim 7 wherein said rotary joint comprising a circumferential groove in said inner section and a groove-matching ridge on said outer section.

9. The device of claim 1 in which said heater, said fan and said motor are supported by a mounting plate affixed to said housing.

10. In combination, a vertical vanity mirror; a multi-light light bar having a series of linearly aligned light sockets therein, said light bar being positioned adjacent to a peripheral edge of said mirror; and a mirror defogger bulb positioned in one of said light sockets and in electrical contact therewith, said defogger bulb comprising:

an electrical plug base and an inner housing section attached thereto;

means including a resistance heater, rotatable fan, and fan-driving motor carried by said inner housing section;

a substantially hemispherical outer bulb section rotatively connected about an axis of rotation relative to said inner section and cooperating with said inner section to enclose said heater, said fan and said motor;

an air inlet extending through said outer bulb section; and an air outlet in said outer bulb section positioned such that ambient air pulled into said connected sections through said inlet by said fan is heated by said resistance heater and directed by said fan through said air outlet to a surface of said mirror, said air outlet being laterally offset from the axis of rotation of said outer section.

11. The combination of claim 10 in which said air inlet is a series of spaced apertures extending through a wall of said outer bulb section.

12. The combination of claim 10 in which said resistance heater comprises a resistance wire coil positioned between said air inlet and said fan.

13. The combination of claim 10 wherein said defogger bulb is energized in series with light bulbs positioned in other of said light sockets.

14. The combination of claim 10 in which said inner housing section and said outer bulb section are rotatably connected a slip joint having an unlimited arc of rotation.

15. The combination of claim 14 further comprising means for locking said outer bulb section with respect to said inner housing section to fix the direction of heated air exiting said defogger bulb.

16. The combination of claim 10 further comprising an adaptor nozzle connected to and extending from said air outlet to convey heated air to said mirror.

* * * * *